US006747682B2

(12) United States Patent
Kidoura et al.

(10) Patent No.: US 6,747,682 B2
(45) Date of Patent: Jun. 8, 2004

(54) THERMAL MASTER MAKING DEVICE AND THERMAL PRINTER INCLUDING THE SAME

(75) Inventors: Yasunobu Kidoura, Miyagi (JP); Satoshi Katoh, Miyagi (JP); Yasumitsu Yokoyama, Miyagi (JP); Yoshiyuki Shishido, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 305 days.

(21) Appl. No.: 09/773,915

(22) Filed: Feb. 2, 2001

(65) Prior Publication Data

US 2001/0028384 A1 Oct. 11, 2001

(30) Foreign Application Priority Data

Apr. 7, 2000 (JP) ..... 2000-106732

(51) Int. Cl.[7] ..... B41J 2/36; B41J 2/365; B41C 1/055

(52) U.S. Cl. ..... 347/189; 347/190; 101/128.4

(58) Field of Search ..... 347/190, 194, 347/189, 188; 400/120.14, 120.1; 101/128.4

(56) References Cited

U.S. PATENT DOCUMENTS 5,685,222 A 11/1997 Yokoyama et al.
5,690,437 A * 11/1997 Yanagisawa et al. .. 400/120.14
5,809,879 A 9/1998 Yokoyama et al.
6,130,697 A 10/2000 Yokoyama et al.

FOREIGN PATENT DOCUMENTS

| | | | |
|---|---|---|---|
| GB | 2 277 904 | 11/1994 | |
| GB | 2 294 906 | 5/1996 | |
| JP | 8-90746 | 4/1996 | |
| JP | 08-090746 | * 9/1996 | ..... B41C/1/055 |
| JP | 11-115145 | 4/1999 | |

* cited by examiner

*Primary Examiner*—Huan Tran
(74) *Attorney, Agent, or Firm*—Oblon, Spivak, McClelland, Maier & Neustadt, P.C.

(57) ABSTRACT

A thermal master making device and a thermal printer including the same are disclosed. A thermistor senses ambient temperature around a thermal head. A correcting device corrects the amount of heat to be generated by the thermal head, i.e., the duration of energization at least two times during a single master making operation. This configuration reduces a change in the perforation conditions of a thermosensitive medium ascribable to the heat accumulation characteristic of the head. The printer achieves high resolution, high-speed master making and space saving.

22 Claims, 20 Drawing Sheets

TEMPERATURE TRANSITION SENSED BY THERMISTER

THERMAL MASTER MAKING DEVICE AND THERMAL PRINTER INCLUDING THE SAME

BACKGROUND OF THE INVENTION

The present invention relates to a thermal master making device for perforating a thermosensitive stencil or similar thermosensitive medium with heat to thereby make a master and a thermal printer including the same.

A digital thermal printer is conventional that uses a thermosensitive stencil as a thermosensitive medium. The thermal printer includes a thermal head having a number of heat generating elements that are arranged in an array in the main scanning direction. The heat generating elements selectively generate heat in accordance with an image signal representative of a document image so as to perforate a stencil. The perforated stencil, or master, is wrapped around a print drum including a porous portion. A press roller or similar pressing member presses a paper sheet or similar recording medium against the master. As a result, ink fed from the inside of the print drum is transferred to the paper sheet via the porous portion of the print drum and the perforations of the stencil, printing an image on the paper sheet.

More specifically, a platen roller is rotated while pressing the master against the thermal head. While the platen roller conveys the master in the subscanning direction perpendicular to the main scanning direction, the heating elements repeatedly generate heat in accordance with the image signal to thereby perforate the stencil.

The base temperature of the thermal head, i.e., the temperature at which the head starts generating heat varies with the environment in which the printer is operated. A change in base temperature translates into a change in peak temperature which Joule heat generated by the heat generating elements is expected to reach, effecting the configuration of perforations. For example, if the base temperature rises, then the area exceeding the perforation threshold of a stencil and the perforation diameter increase. Conversely, the perforation diameter decreases in a low temperature range. Further, the thermal response of the stencil itself is dependent on the environment. The thermal response refers to a period of time necessary for the stencil to reach a threshold. Consequently, a change in ambient temperature results in a change in perforation condition and therefore effects the quality of a print.

High resolution, high-speed master making and space saving (including compact design and low cost) are required of a modern thermal master making device. In practice, there are required resolution of 600 dpi (dots per inch) for size A3, master making speed of 2 milliseconds per line higher than the conventional 3 milliseconds per line, and the size reduction of a thermal head. The size reduction of a thermal head leads to high yield and low cost.

The above requirements, however, cannot be met without further aggravating the ill effect of a heat accumulation characteristic particular to a thermal head and therefore without causing the perforation conditions to vary, as will be described more specifically later.

A relation between a thermal head featuring high resolution, high-speed master making and space saving and the heat accumulation characteristic will be described hereinafter. As for high resolution, when the resolution of a thermal head is simply increased from 400 dpi to 600 dpi for size A3, the number of heat generating elements to generate heat increases. Therefore, for given thermal response of a stencil, the amount of heat to be generated simply increases. Further, an increase in the resolution of a thermal head translates into a decrease in the size of the individual heat generating element. Therefore, to guarantee a required amount of heat, it is necessary to raise the peak of Joule heat for given drive conditions. It follows that for a given level of heat output form a thermal head itself, resolution increases the amount of heat to accumulate in the head if simply increased. The level of heat is determined by the surface area of an aluminum radiation plate.

When the master making speed is increased, not only the duration of current supply to the heat generating elements of a thermal head, but also the duration of interruption of current supply (release of heat). Also, a stencil must be conveyed at a higher speed with the result that heat transfer efficiency from the heat generating elements to the stencil is lowered. Consequently, high-speed master making needs higher Joule heat than low-speed master making and therefore increases the amount of heat to accumulate in the head.

As for space saving, a decrease in the size of a thermal head itself results in a decrease in the size of the aluminum radiation plate and therefore in the thermal capacity of the head, i.e., a period of time necessary for the base temperature to rise. This, coupled with the fact that the surface area of the radiation plate decreases, reduces the amount of heat to be released to the outside and thereby increases the amount of heat to accumulate in the head.

As stated above, a thermal head satisfying the previously stated conditions causes more heat to accumulate therein than conventional. We experimentally found that such heat aggravated a difference in perforation condition between the leading edge portion and the tailing edge portion of a single master, which has not been addressed to in the past. Particularly, when image data had a high print ratio in the main and subscanning directions, the perforation diameter became far greater than a designed value in the trailing edge portion of a master, resulting in offset.

Moreover, irregularity in the various portions of a thermal head effects perforations. It was experimentally found that in, e.g., a portion where the resistance of the head approached the lower limit away from a mean value, perforations formed by the heat generating elements joined each other in the subscanning direction and lowered the resistance of a master to repeated printing. This is because in the case of constant voltage drive the heat generating elements whose resistance is lower than the mean value generate more heat than the others. Likewise, in a portion where perforations were formed by a small amount of heat, perforations formed by the heat generating elements joined each other in the subscanning direction and also lowered the resistance of a master to repeated printing.

Technologies relating to the present invention are disclosed in, e.g., Japanese Patent Laid-Open Publication Nos. 8-90746 and 11-115145, U.S. Pat. Nos. 5,685,222, 5,809,879, and GB 2277904A and 2294906A.

SUMMARY OF THE INVENTION

It is therefore an object of the present invention to provide a thermal master making device capable of obviating a difference in perforation condition between the leading edge portion and the trailing edge portion of a master as well as offset and low resistance to repeated printing, and a thermal printer including the same.

It is another object of the present invention to provide a low cost, thermal master making device using a conventional construction as far as possible, and a thermal printer including the same.

In accordance with the present invention, a thermal master making device includes a thermal head having a plurality of heat generating elements arranged in an array in the main scanning direction. A thermosensitive medium is moved relative to the head in the subscanning direction perpendicular to the main scanning direction while pressing the medium against the head. The heat generating elements repeatedly generate heat in accordance with an image signal to thereby make a master. The master making device includes a sensor for sensing ambient temperature around the head, and a correcting circuit configured to correct the amount of heat to be generated by the head in accordance with the ambient temperature sensed by the sensor. The amount of heat is corrected on the basis of the ambient temperature during master making operation.

A thermal printer including the above-described thermal master making device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, problems with a thermal printer including a thermal head will be described specifically. The base temperature of the thermal head itself is susceptible to the environment in which the stencil printer is operated, as stated earlier. A change in base temperature translates into a change in peak temperature which Joule heat generated by the heat generating elements of the thermal head is expected to reach, effecting the configuration of perforations.

Figure 1:
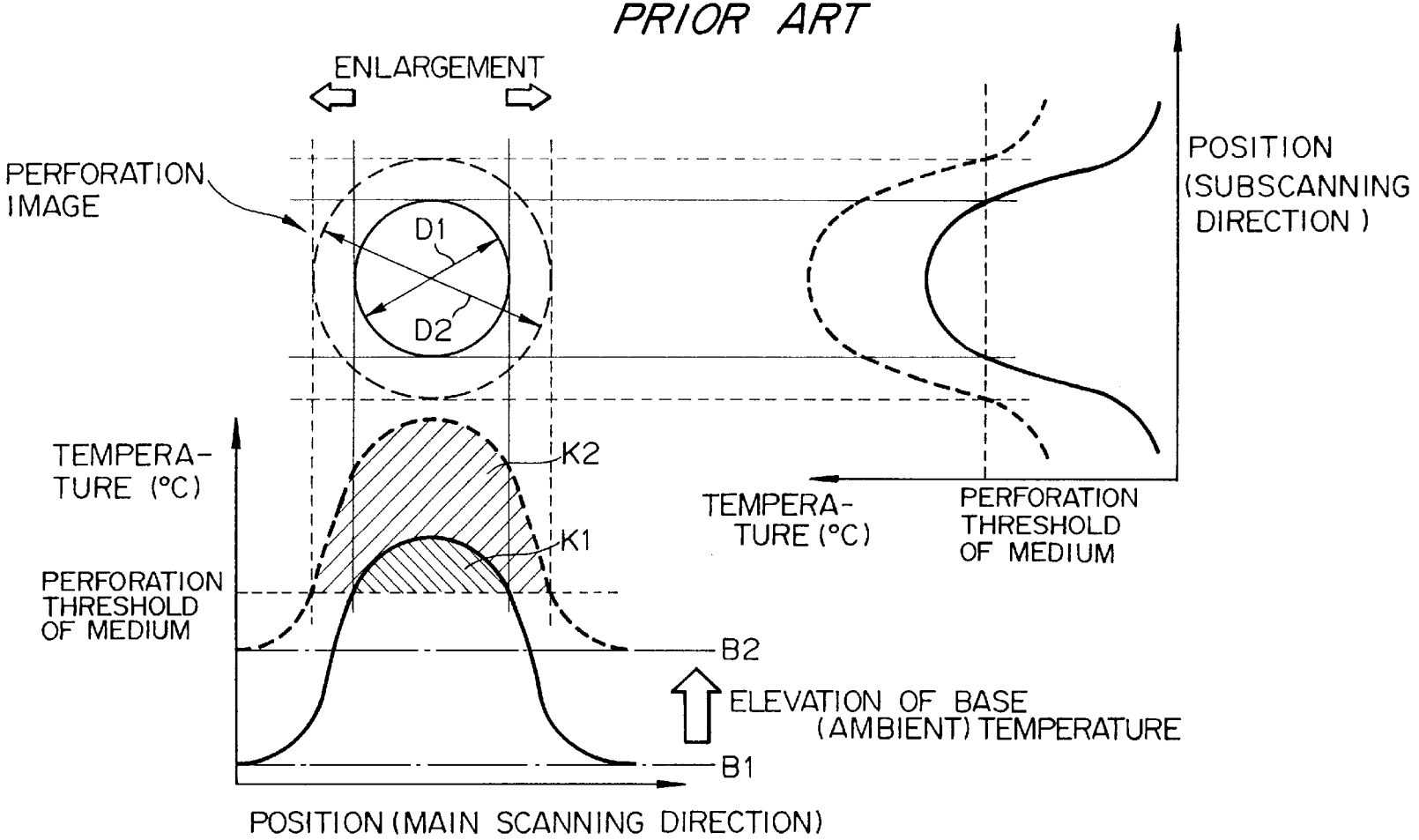
FIG. 1 PRIOR ART
FIG. 1 is a graph showing a relation between the base temperature of a thermal head and the perforation diameter.

For example, as shown in FIG. 1, if the base temperature rises from B1 to B2, then the area exceeding the perforation threshold of a thermosensitive stencil or similar thermosensitive medium varies from K1 to K2 while the perforation diameter increases from D1 to D2. Conversely, the perforation diameter decreases in a low temperature range. Further, the thermal response of the stencil itself is dependent on the environment.

Figure 2B:
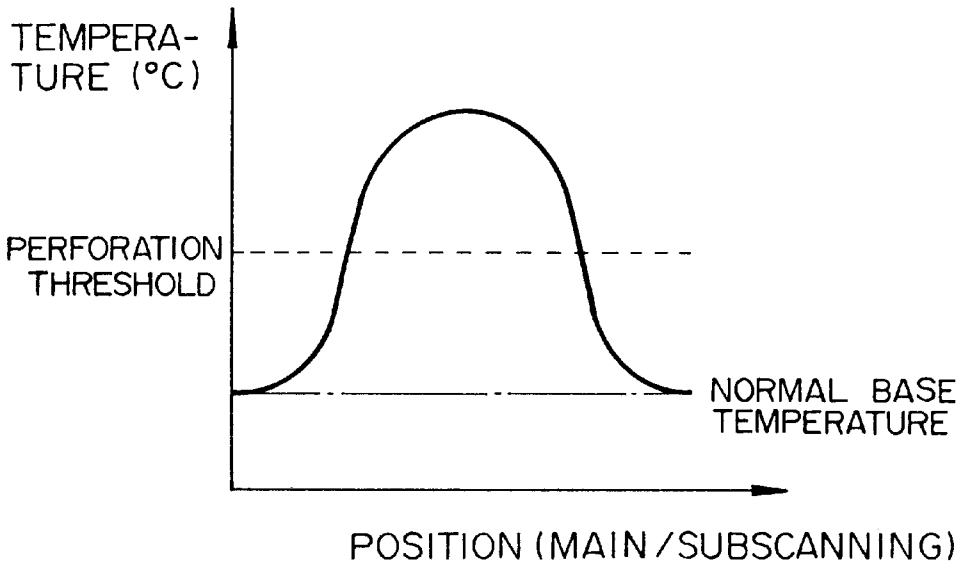
FIG. 2B PRIOR ART
FIG. 2B is a graph showing a relation between heating temperature and a perforation threshold.
Figure 2A:
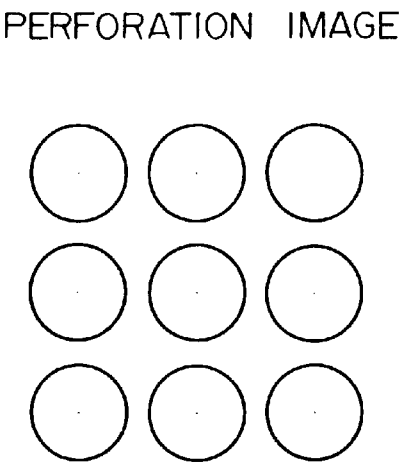
FIG. 2A PRIOR ART
FIG. 2A is a view showing a specific configuration of perforations formed at room temperature.
Figure 3A:
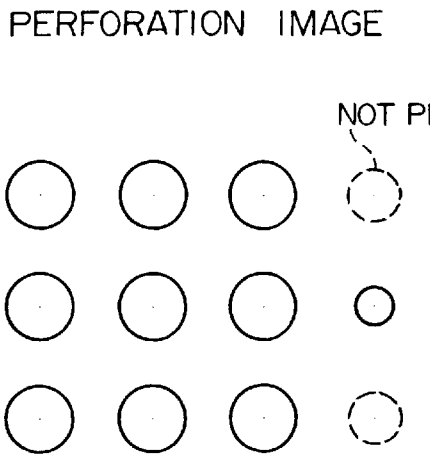
FIG. 3A PRIOR ART
FIG. 3A is a view showing specific perforations formed at low temperature.
Figure 3B:
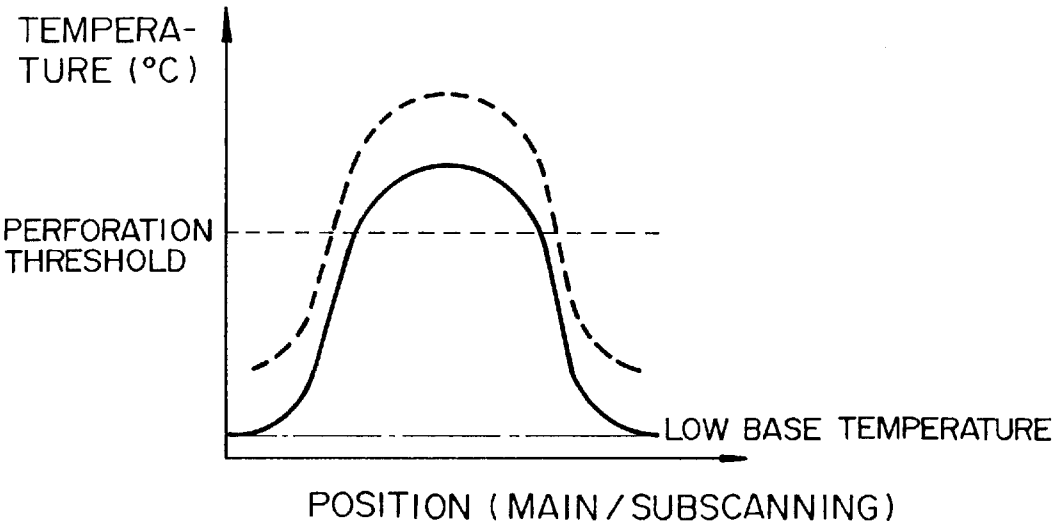
FIG. 3B PRIOR ART
FIG. 3B is a graph showing a relation between heating temperature and a perforation threshold.

More specifically, FIGS. 2A and 2B show a specific reference or optimal perforation condition achievable at room temperature (around 23° C.). Assume that the thermal head is driven in a low temperature environment (lower than room temperature) by the same drive energy as in the room temperature environment. Then, as shown in FIGS. 3A and 3B, the head fails to perforate some portions of the stencil that it should perforate, resulting in an image partly lost in the form of white spots.

Figure 4B:
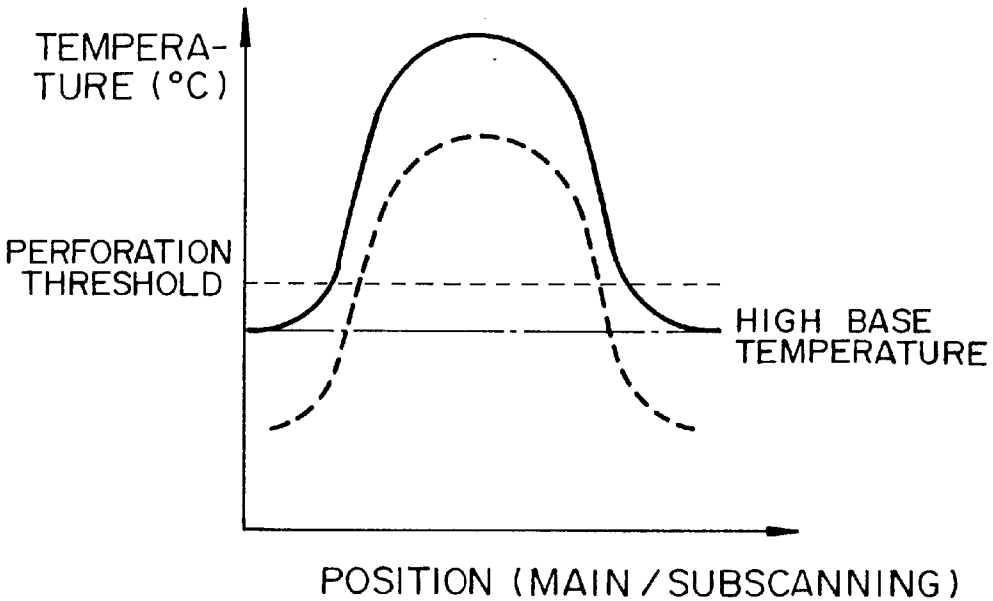
FIG. 4B PRIOR ART
FIG. 4B is a graph showing a relation between heating temperature and a perforation threshold.
Figure 4A:
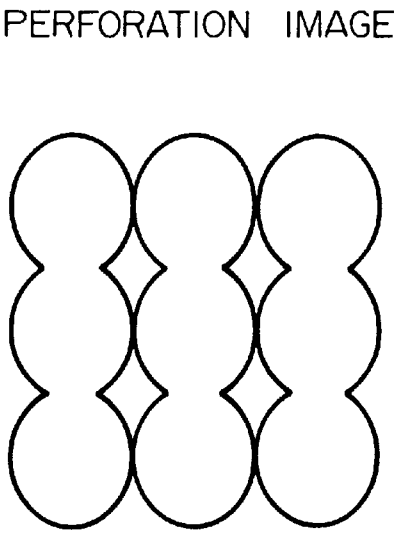
FIG. 4A PRIOR ART
FIG. 4A is a view showing specific perforations formed at high temperature.

Conversely, in a high temperature environment (higher than room temperature), the perforation diameter of the stencil exceeds a designed diameter and causes excess ink to flow out to bring about so-called offset. In the worst case, as shown in FIGS. 4A and 4B, nearby perforations join each other and reduce the strength of the stencil. As a result, the perforated stencil or master cannot withstand repeated printing, i.e., elongates an image or tears itself. That is, the resistance of the stencil to repeated printing is lowered.

Figure 5:
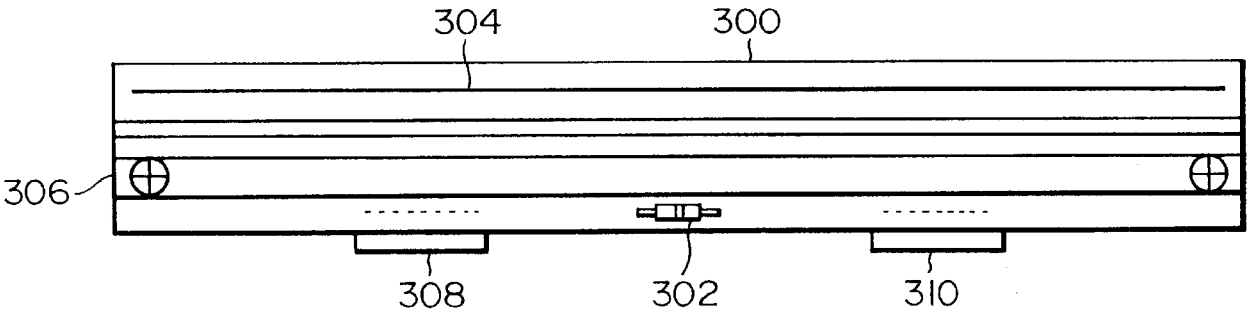
FIG. 5 PRIOR ART
FIG. 5 is a plan view showing a conventional thermal head.

FIG. 5 shows a conventional solution to the above-described problems. As shown, a thermistor 302 is positioned in contact with or in the vicinity of a thermal head 300 for sensing ambient temperature around the head 300. Immediately before the start of a master making operation, the thermistor 302 senses the ambient temperature. Current is fed to the head 300 for an optimal period of time matching with the output of the thermistor 302 and experimentally determined beforehand. The optimal period of time or duration is read out of a table. Stated another way, drive energy for driving the thermal head 300 is controlled in accordance with the ambient temperature at the time of the start of a master making operation. The head 300 includes an array of heat generating elements 304, an IC (Integrated Circuit) cover 306, a power source connector 308, and a signal connector 310.

Figure 6:
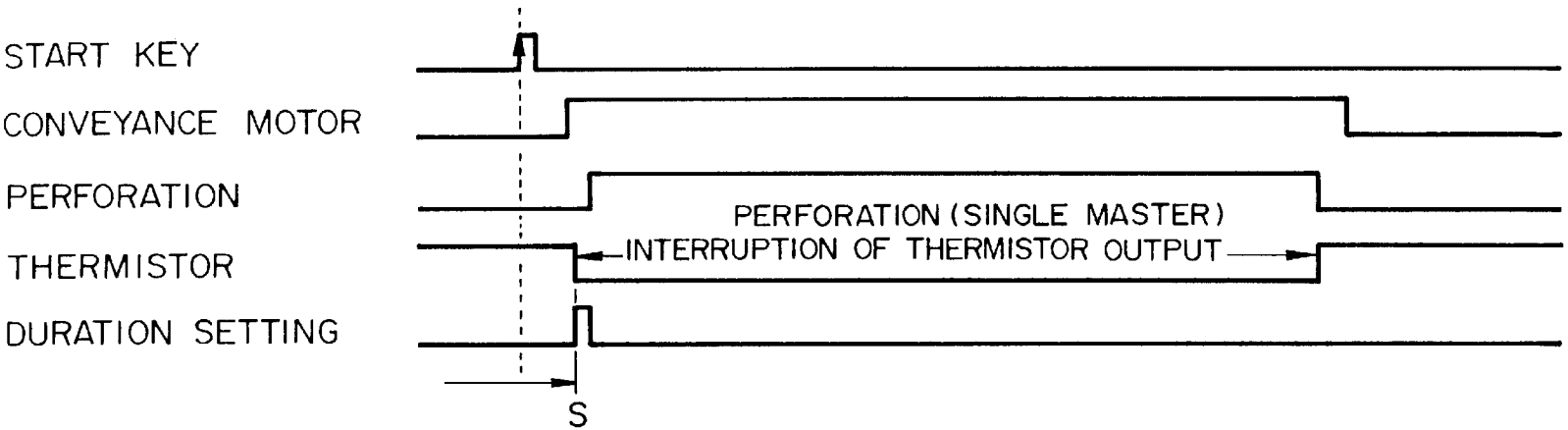
FIG. 6 PRIOR ART
FIG. 6 is a timing chart demonstrating conventional correction control based on ambient temperature.

More specifically, as shown in FIG. 6, the thermistor 302 senses the ambient temperature around the head 300 once before the start of a master making operation. Current is fed to the head 300 for an optimal period of time matching with the sensed temperature, so that constant perforations (images) can be formed in successive masters. The thermistor 302 repeatedly senses the ambient temperature at a preselected period up to a time S at which the duration of energization, or current supply to the head 300, is set. The duration of energization is selected and set in accordance with the last output of the thermistor 302 appeared before the start of a master making operation. In FIG. 6, a conveyance motor refers to a motor that drives a platen roller not shown.

The previously mentioned table lists both of ambient temperatures and optimal durations of energization each corresponding to a particular ambient temperature level stepwise. Specifically, a range between 10° C., which is the lower limit of operation temperature of a stencil printer, and 54° C., which is the upper limit of the same, is equally divided into sixteen. In this case, the duration of energization is varied on a 2.75° C. basis. A step of 2.75° C. is based on experimental results showing that for given head drive conditions, a difference in ambient temperature that renders differences in picture conspicuous is 2.75° C. or above. The differences in picture pertain to density, ink consumption, offset and so forth. Stated another way, when the difference in ambient temperature is less than 2.75° C., factors other than the differences in the perforation conditions of the stencil have great influence on a picture.

Figure 7A:
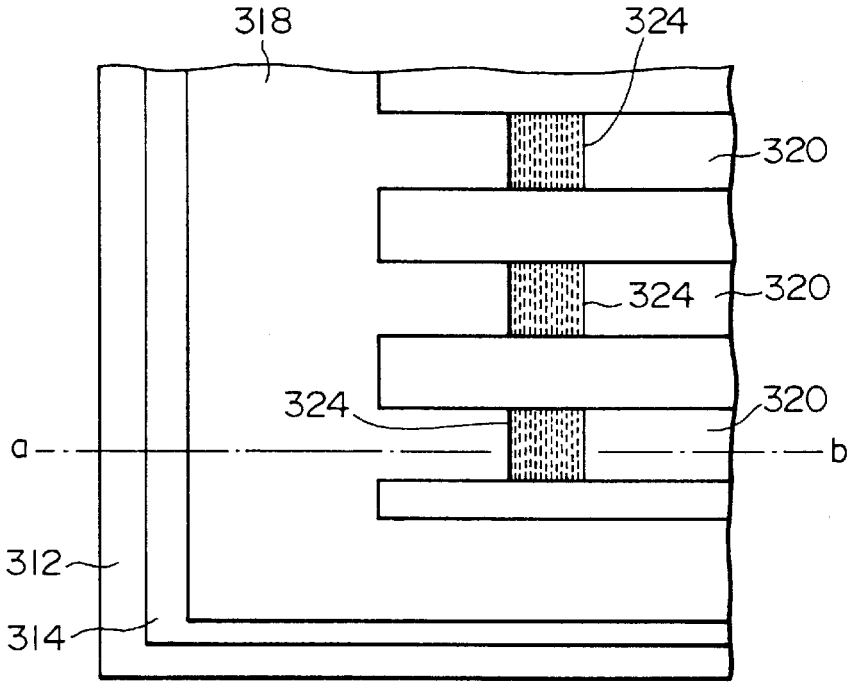
FIG. 7A PRIOR ART
FIG. 7A is a plan view showing a specific configuration of a conventional thermal head.
Figure 7B:
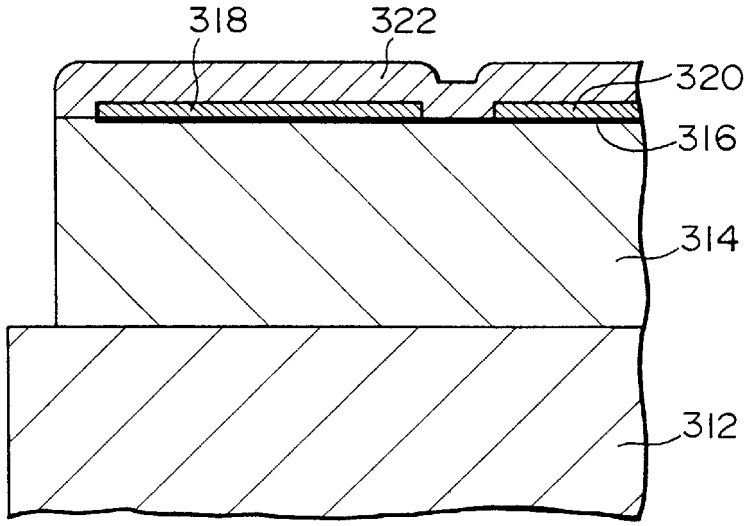
FIG. 7B PRIOR ART
FIG. 7B is a section taken in a plane a-b shown in FIG. 7*a;*

It is a common practice with the stencil printer to correct the amount of heat in accordance with the number of heat generating elements (resistors) to be driven at the same time, i.e., to effect so-called common drop correction. FIGS. 7A and 7B show a typical thin film, line type thermal head customary with a stencil printer. As sown, this type of thermal head includes a ceramic substrate 312, a glaze layer or heat insulation layer 314 formed on the substrate 312, a resistance layer 316 formed on the glaze layer 314, a common electrode 318, individual electrodes 320, and a protection film 322 covering the electrodes 318 and 320. The resistance layer 316 is exposed between the common electrode 318 and the individual electrodes 320, forming heat generating elements 324.

Figure 8:
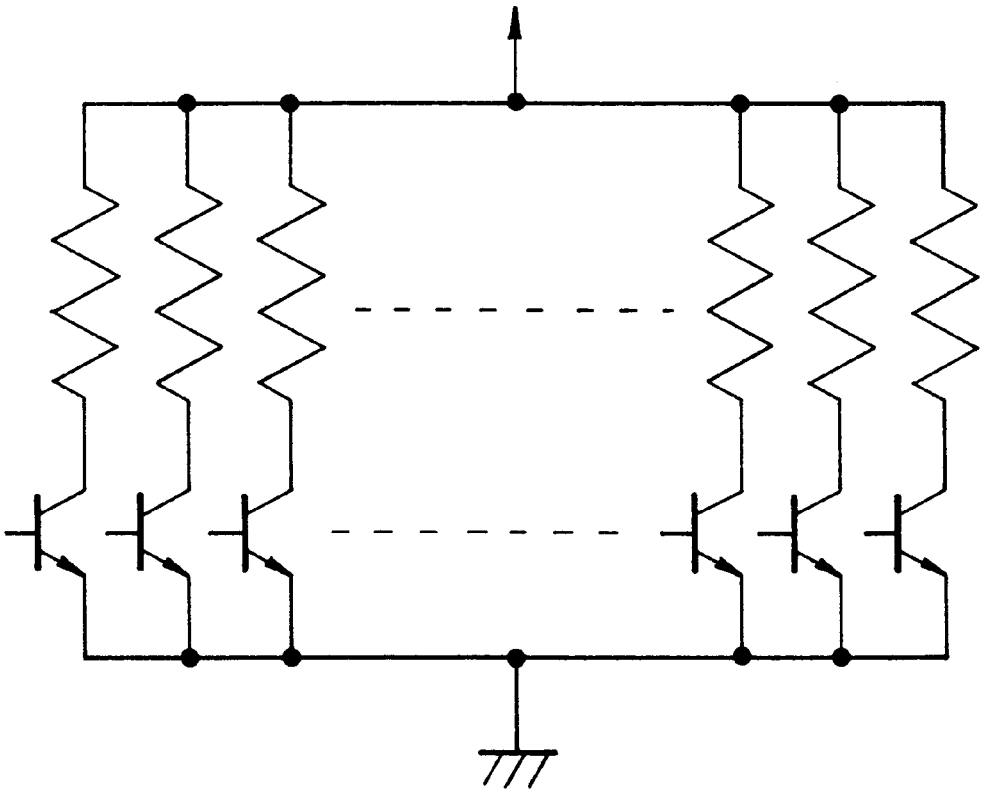
FIG. 8 PRIOR ART
FIG. 8 is a circuit diagram representative of the conventional thermal head.

The thermal head of the type shown in FIGS. 7A and 7B allows fine heat generating elements essential for the stencil printer to be produced at low cost. However, this type of head is susceptible to a common drop because it has the heat generating elements arranged as shown in FIG. 8. A common drop refers to an occurrence that much current flows in accordance with the number of heat generating elements driven at the same time and makes wiring resistance not negligible, thereby lowering voltage to be actually applied to the heat generating elements. A decrease in voltage directly translates into a decrease in head drive energy. This reduces the perforation diameter and therefore causes many white spots to appear in the resulting image.

Figure 9:
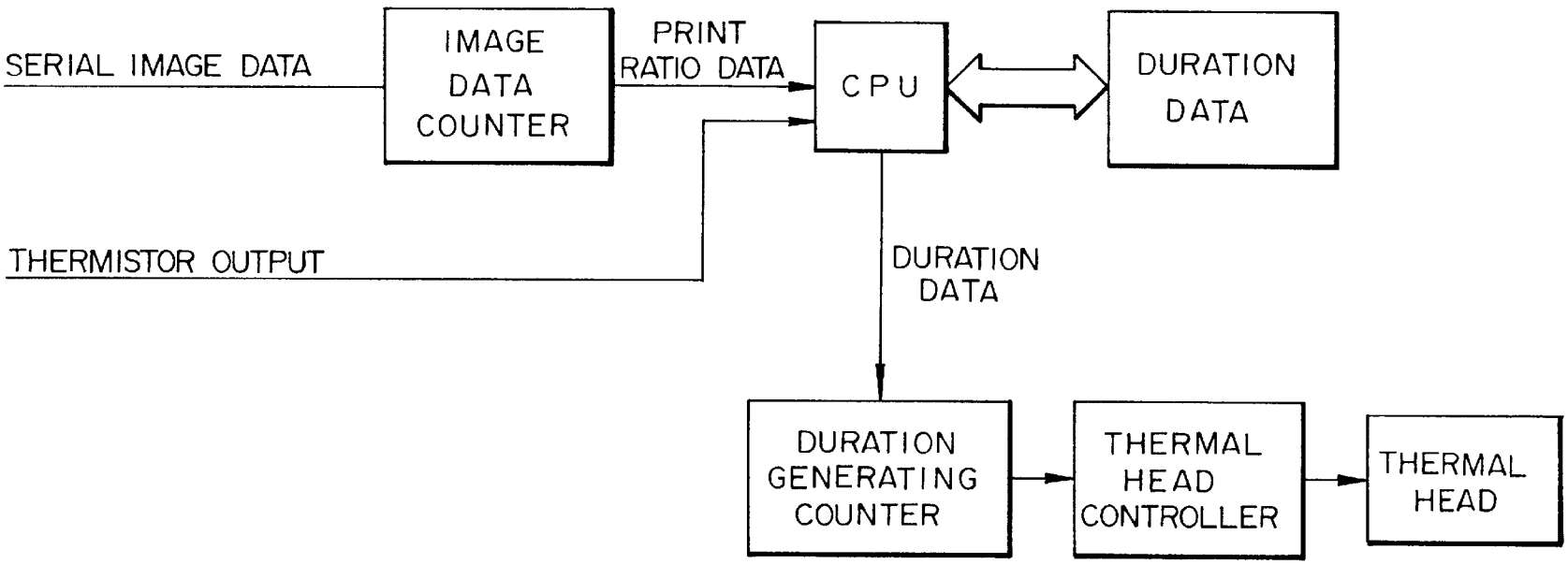
FIG. 9 PRIOR ART
FIG. 9 is a block diagram schematically showing a conventional control system for a thermal master making device.
Figure 10:
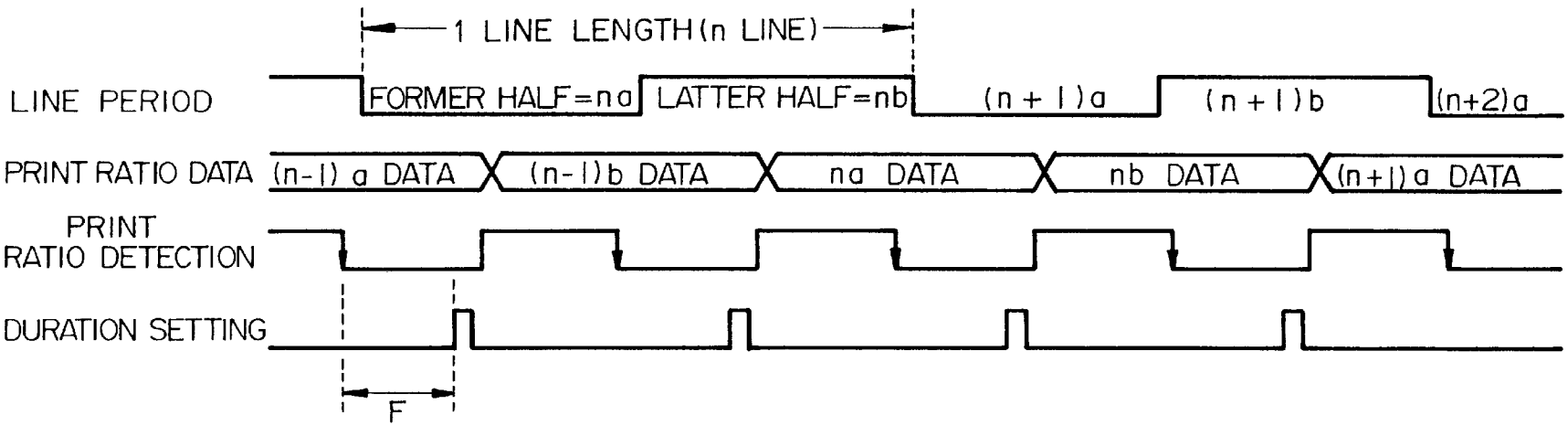
FIG. 10 PRIOR ART
FIG. 10 is a timing chart showing conventional common drop correction.

FIGS. 9 and 10 show a conventional measure taken against a common drop. As shown, the number of heat generating elements to be driven at the same time is determined on the basis of image data. A range between the print ratios of 0% and 100% is equally divided into sixteen. An optimal duration of energization matching with print ratio data and experimentally determined beforehand is selected out of a table. Specifically, in FIG. 10, a duration of energization is selected and calculated in a range F and fed to a duration generating counter that generates a duration of energization.

Figure 11:
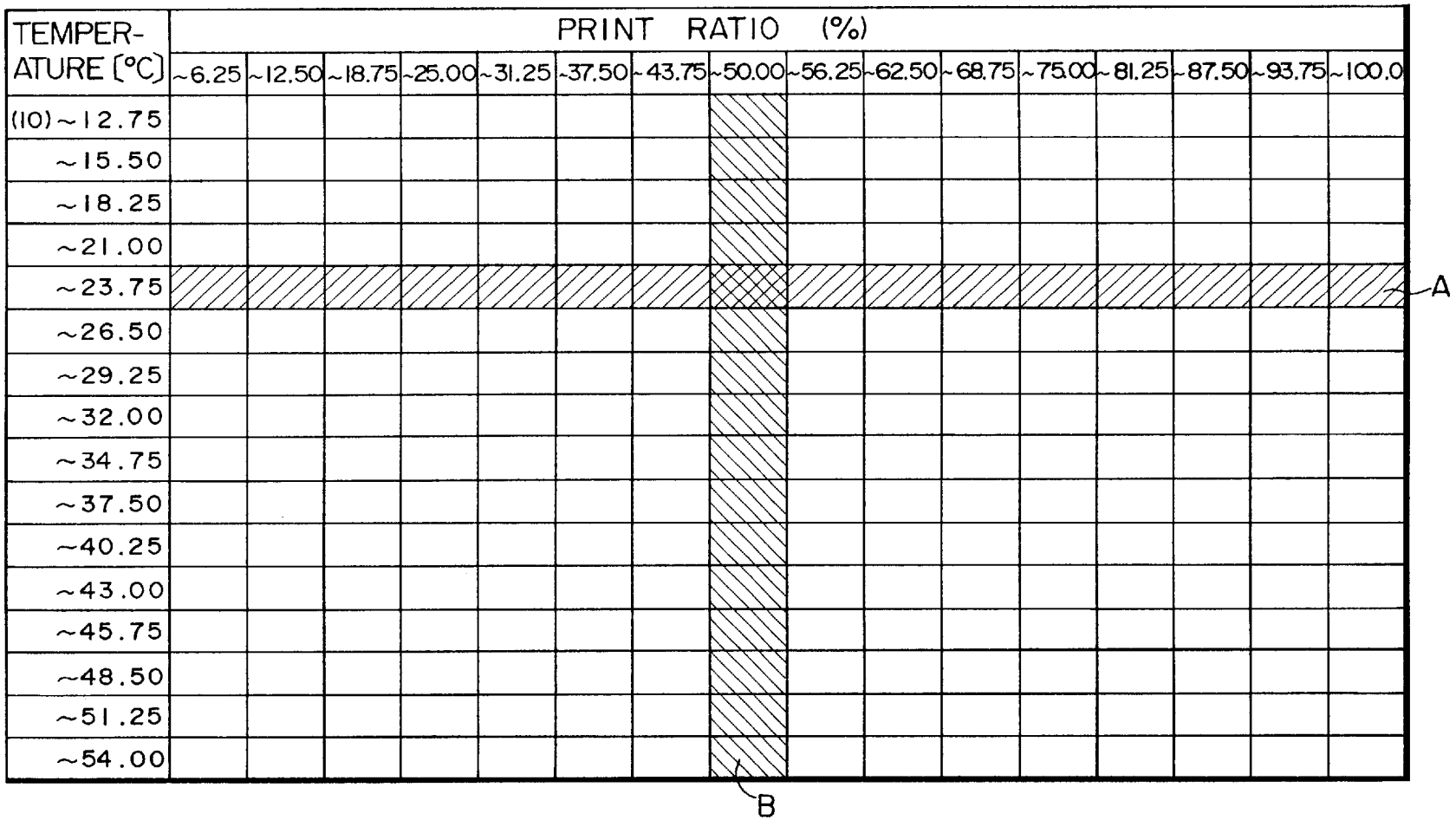
FIG. 11 PRIOR ART
FIG. 11 is a table showing a conventional relation between ambient temperature and print ratio data.

In practice, the correction based on the ambient temperature and the correction based on print ratio data (common drop correction) are executed in combination. Specifically, as shown in FIG. 11, sixteen patterns of duration data based on ambient temperature and sixteen patterns of duration data based on print ratio data are determined by experiments beforehand. Such patterns are listed in a 16×16 matrix on a table, showing a relation between ambient temperature and print ratio.

Before the start of a master making operation, data representative of a duration of energization, which corresponds to the ambient temperature, is selected and narrowed down to sixteen patterns, i.e., a region A is selected. After the start of the master making operation, data corresponding to the print ratio data is selected from the above sixteen patterns, i.e., a region B is selected. Duration data located at a position where the regions A and B cross each other is fed to the duration generating counter, FIG. 9. The above data are sometimes determined by calculation instead of experiment.

High resolution, high speed perforation, space saving (including compact design and low cost) and so forth are required of a master making device included in a modern stencil printer, as also stated earlier. Such demands, however, cannot be met without further aggravating the ill effect of a heat accumulation characteristic particular to a thermal head and therefore without varying the configuration of perforations. This will be described more specifically hereinafter.

Figure 12:
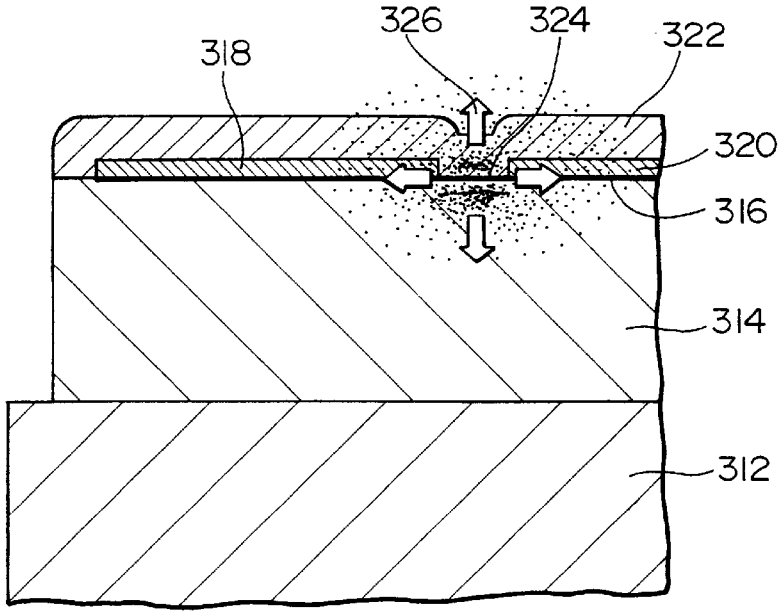
FIG. 12 PRIOR ART
FIGS. 12 and 13 are fragmentary sections showing how heat is radiated from the conventional thermal head.
Figure 13:
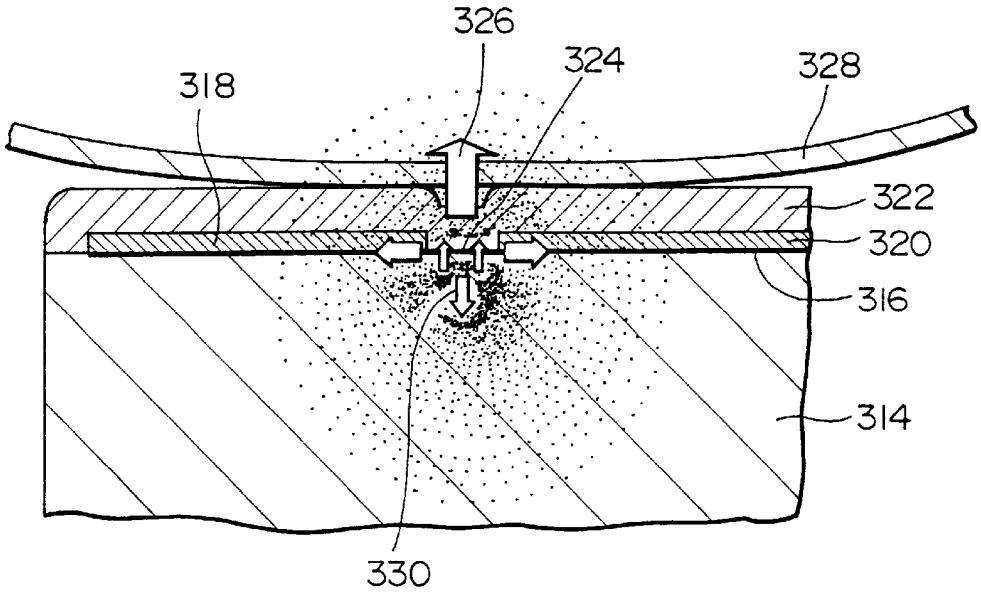
FIG. 13 PRIOR ART

FIG. 12 shows a thermal head configured to efficiently transfer heat to a stencil or similar thermosensitive medium with small energy. As shown, the thermal head, labeled 300, includes a heat generating element 324 that generates Joule heat 326. The Joule heat tends to spread spherically in all directions. On the other hand, as shown in FIG. 13, a stencil 328 moves on a protection layer 322. An insulation layer 314 blocks heat 330 tending to spread downward below the heat generating element 324, so that more heat is released toward the stencil 328 above the protection layer 322.

Excessively perforating a stencil with much heat is not desirable. Ideally, each heat generating element should form a single perforation in a stencil, so that all the expected perforations are formed and separate from each other. It is therefore necessary to fully release heat as soon as a single perforation is formed. However, releasing the entire heat cannot be done without resorting to a substantial period of time and is impracticable with a line type thermal head.

Moreover, a glaze layer 314 stores heat in order to efficiently transfer heat to the stencil 328 with small energy. Consequently, a substantial amount of heat is not released, but is accumulated in the thermal head. It follows that repeated heat generation causes the temperature of the head, i.e., the base temperature to rise little by little, causing the configuration of perforations to vary between the leading edge portion and the trailing edge portion of a master. More specifically, the perforation diameter sequentially increases from the leading edge toward the trailing edge of a master.

As stated above, a thermal head meeting the previously stated demands would accumulate more heat than the conventional thermal head and would thereby aggravate offset while lowering the resistance of a master to repeated printing.

Figure 14:
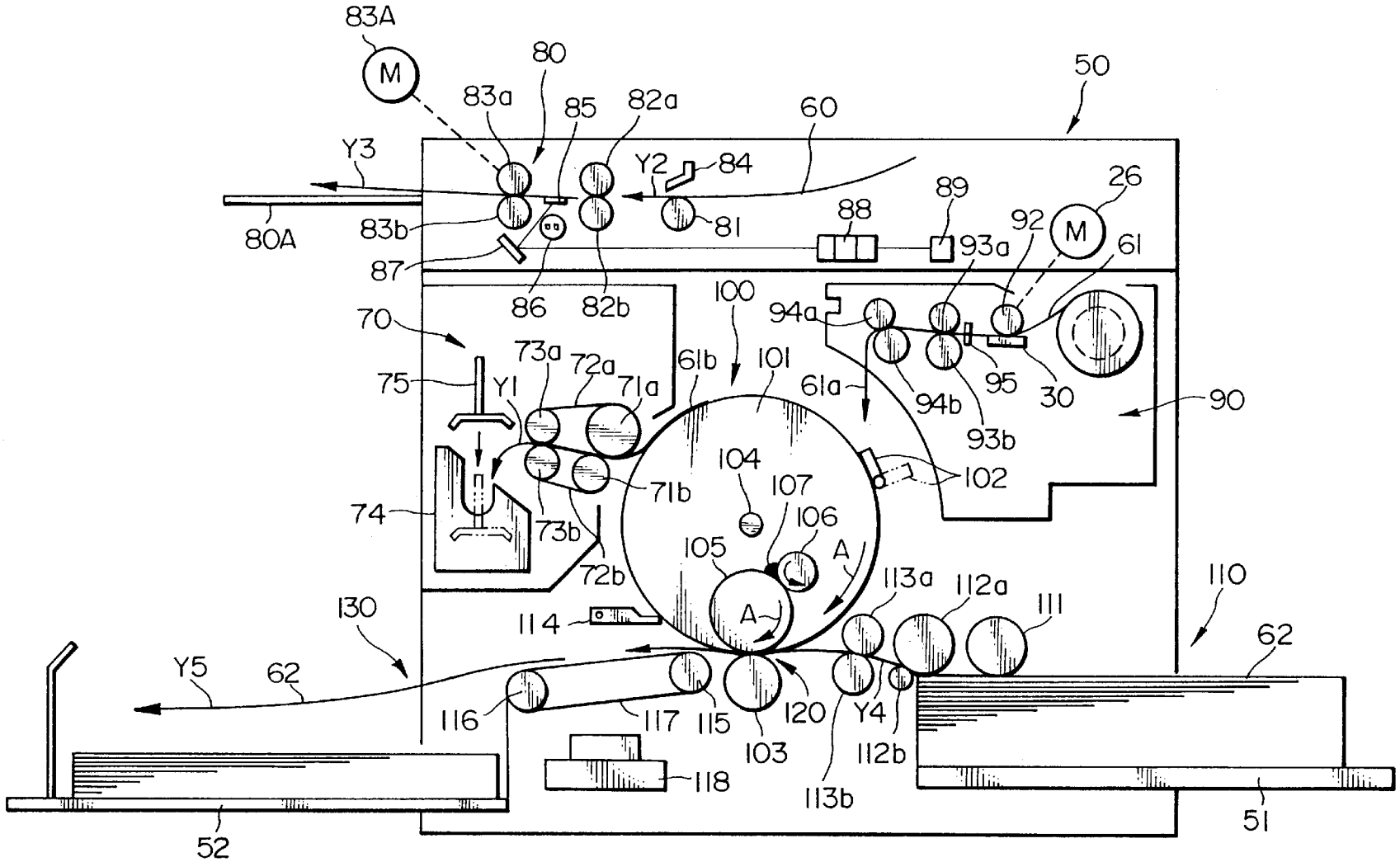
FIG. 14 is a view showing a thermal printer embodying the present invention.

Referring to FIG. 14, a stencil printer including a thermal master making device embodying the present invention will be described. As shown, the stencil printer includes a housing or cabinet 50. A scanning section 80 for reading a document is arranged in the upper portion of the housing 50. A thermal master making device 90 is positioned below the scanning section 80. A print drum section 100 is located at the left-hand side of the master making section 90, as viewed in FIG. 14, and includes a porous print drum 101. A master discharging section 70 is arranged at the left-hand side of the print drum section 100, as viewed in FIG. 14. A paper feeding section 110 is located below the master making section 90. A pressing section 120 is positioned beneath the print drum 101. A paper discharging section 130 is arranged in the bottom left portion of the housing 50.

In operation, the operator of the printer sets a desired document 60 on a tray, not shown, arranged on the top of the scanning section 80 and then presses a perforation start key not shown. In response, the printer starts discharging a used master. Specifically, a master 61*b* used to print images last time is left on the outer periphery of the print drum 101. First, the print drum 101 with the used master 61*b* is rotated counterclockwise, as viewed in FIG. 14*l*. As the trailing edge of the used master 61*b* approaches a pair of peel rollers 71*a* and 71*b* being rotated, the peel roller 71*b* picks up the trailing edge of the master 61*b*. A pair of conveyor belts 72*a* and 72*b* are passed over the peel rollers 71*a* and 71*b* and a pair of discharge rollers 73*a* and 73*b*, which are positioned at the left-hand side of the rollers 71*a* and 71*b*. The conveyor belts 72*a* and 72*b* convey the used master 61*b* separated from the print drum 101 by the peel rollers 71*a* and 71*b* in a direction Y1. The used master 61*b* is then introduced into a waste master box 74. At this instant, the print drum 101 is continuously rotated counterclockwise. A plate 75 compresses the used master 61*b* in the waster master box 74.

In parallel with the master discharging step described above, the scanning section 80 reads the document. Specifically, a pickup roller 81, a pair of front rollers 82*a* and 82*b* and a pair of rear rollers 83*a* and 83*b* in rotation sequentially convey the document 60 laid on the tray in directions Y2 and Y3. When the operator stacks a plurality of documents on the tray, a separator in the form of a blade 84 causes only the bottom document to be fed from the tray. A motor 83A drives the rear roller 83*a* and drives the front roller 82*a* via a timing belt, not shown, passed over the rear roller 83*a* and the front roller 82*a*. The rollers 82*b* and 83*b* are driven rollers.

Specifically, the scanning section 80 includes a lamp or light source 86. While the document 60 is conveyed on and along a glass platen 85, the lamp 86 illuminates the document 60. The resulting imagewise reflection from the document 60 is incident to a CCD (Charge Coupled Device) image sensor or similar image sensor 89 via a mirror 87 and a lens 88. In this manner, the document 60 is read by a conventional reduction type of document reading system. The document 60 is then driven out to a tray 80A. An electric signal output from the image sensor 89 is input to an analog-to-digital converter, not shown, disposed in the housing 50 and converted to a digital image data thereby.

In parallel with the document reading step described above, a master making and feeding step is executed in accordance with the digital signal or image data output from the analog-to-digital converter. Specifically, a thermosensitive stencil 61 implemented as a roll is set in a preselected portion of the master making device 90 and paid out from the roll. A platen roller 92 presses the stencil 61 against a thermal head 30. The platen roller 92 and a pair of rollers 93*a* and 93*b*, which are in rotation, cooperate to convey the stencil 61 intermittently to the downstream side.

A number of fine, heat generating portions are arranged on the head 30 in an array in the main scanning direction. The heat generating portions selectively generate heat in accordance with the digital image data sent from the analog-to-digital converter. The heat generating portions generating heat melt and thereby perforate the portions of a thermosensitive resin film, which is included in the stencil 61, contacting the heat generating portions. As a result, a perforation pattern is formed in the stencil 61 in accordance with the image data.

A pair of rollers 94*a* and 94*b* convey the leading edge of the perforated stencil 61, i.e., the leading edge of a master 61*a* toward the outer periphery of the print drum 101. A guide member, not shown, steers the master 61*a* downward with the result that the master 61*a* hangs down toward a damper 102 mounted on the print drum 101. At this time, the damper 102 is held open at a master feed position, as indicated by a phantom line in FIG. 14.

At a preselected timing, the damper 102 clamps the leading edge of the master 61*a*. The print drum 101 is then rotated in a direction A (clockwise) while wrapping the master 61*a* therearound. After the entire master 61*a* has been formed, a cutter 95 cuts it off at a preselected length. This is the end of the master making and feeding step.

The master making and feeding step is followed by a printing step. A stack of paper sheets or similar recording media 62 are stacked on a tray 51. A pickup roller 111 and a pair of separator rollers 112*a* and 112*b* pay out the top paper sheet 62 toward a pair of feed rollers 113*a* and 113*b* in a direction Y4. The feed rollers 113*a* and 113*b* convey the paper sheet 62 toward the pressing section 120 at a preselected timing synchronous to the rotation of the print drum 101. When the paper sheet 62 arrives at a position between the print drum 101 and the press roller 103, the press roller 103 is moved upward in order to press the paper sheet 62 against the master 61*a* wrapped around the print drum 101. Consequently, ink oozes out via the porous portion of the print drum 101, not shown, and the perforations of the master 61*a*. The ink is then transferred to the surface of the paper sheet 62, forming an ink image.

Specifically, an ink feed tube 104, an ink roller 105 and a doctor roller 106 are disposed in the print drum 101. Ink is fed from the ink feed tube 104 to an ink well 107 between the ink roller 105 and the doctor roller 106. The ink roller 105, which contacts the inner periphery of the print drum 101, is rotated in the same direction as and in synchronism with the print drum 101, feeding the ink to the inner periphery of the print drum 101. The ink is implemented by W/O type emulsion ink.

A peeler 114 peels off the paper sheet 62, which carries the ink image thereon, from the print drum 101. A belt 117 is passed over an inlet roller 115 and an outlet roller 116 and turned counterclockwise, as viewed in FIG. 14. The belt 117 conveys the paper sheet 62 toward the paper discharging section 130 in a direction Y5. At this instant, a suction fan 118 retains the paper sheet 62 on the belt 117 by suction. Finally, the paper sheet 62 is driven out to a tray 52 as a trial print.

If the trial print is acceptable, the operator inputs a desired number of prints on numeral keys, not shown, and then presses a print start key not shown. In response, the printer repeats the paper feeding step, printing step and paper discharging step a number of times corresponding to the desired number of prints.

Figure 15:
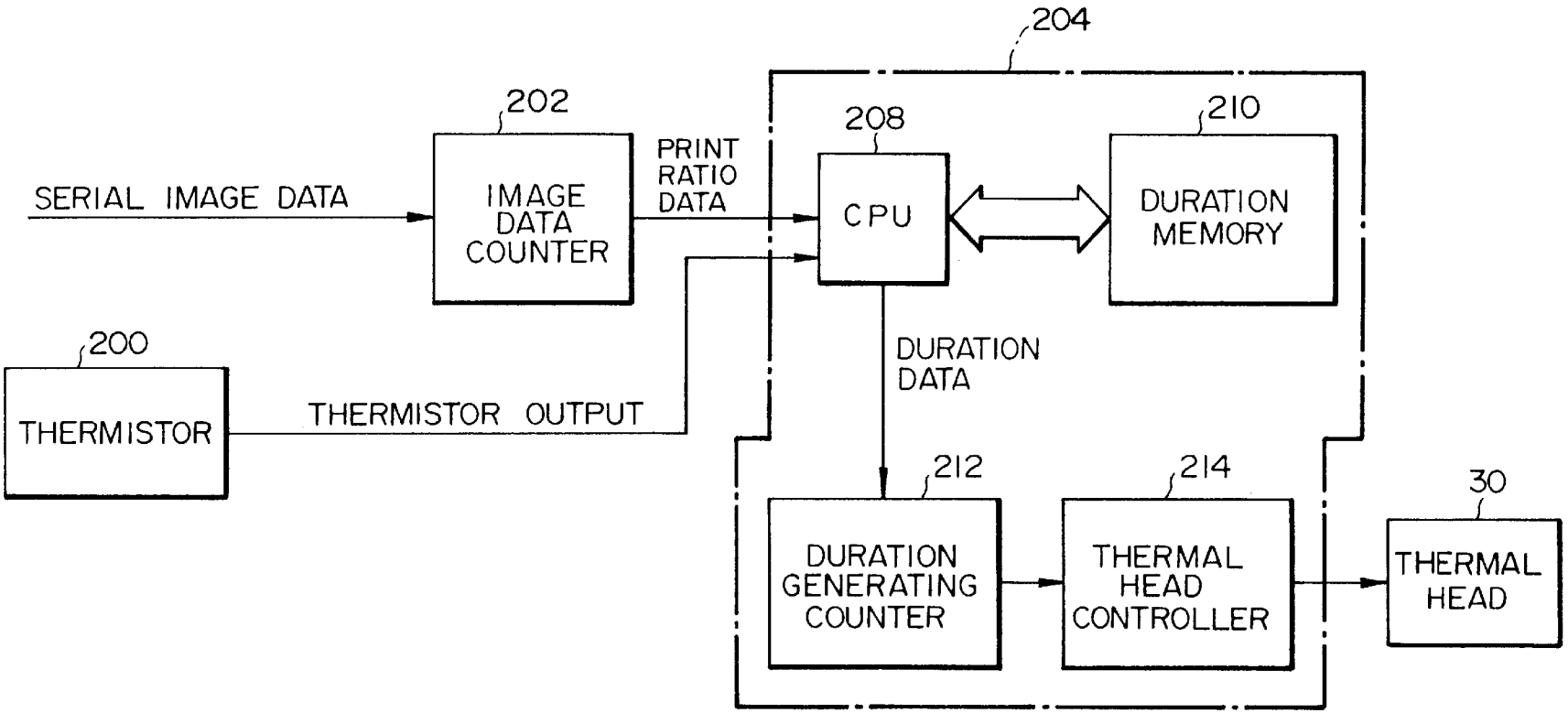
FIG. 15 is a block diagram schematically showing a control system included in the illustrative embodiment.

Reference will be made to FIG. 15 for describing a control system that controls the master making device 90. As shown, the master making device 90 includes a thermistor 200, an image data counter 202 and a heat correcting section 204 in addition to the previously stated components including the thermal head 30. The thermistor 200 plays the role of sensing means for sensing ambient temperature around the thermal head 30. The image data counting 202 serves as detecting means for detecting a print ratio in terms of the number of heat generating elements to be energized at the same time. The heat correcting section 204 corrects the amount of heat to be generated by the thermal head 30 on the basis of the output of the thermistor 200 and the output of the image data counter 202. This control system is identical with the conventional control system. The thermal head 30 is conventional and will not be described specifically.

The heat correcting section 204 includes a CPU (Central Processing Unit) including a ROM (Read Only Memory) and a RAM (Random Access Memory), a duration memory 210, a duration generating counter 212, and a thermal head controller 214. The entire heat correcting section 204 is implemented as a microcomputer.

It has been customary to correct the amount of heat to be generated by the head 30 only once before the start of a master making operation, as discussed earlier. By contrast, the illustrative embodiment corrects the amount of heat even during master making operation and at least two times for a single master making operation. This successfully prevents the master perforating conditions from varying due to heat accumulated in the thermal head 30. Specifically, as shown in FIG. 16, the illustrative embodiment executes such correction control five times for a single master making operation at intervals C of 5 seconds or less.

Figure 16:
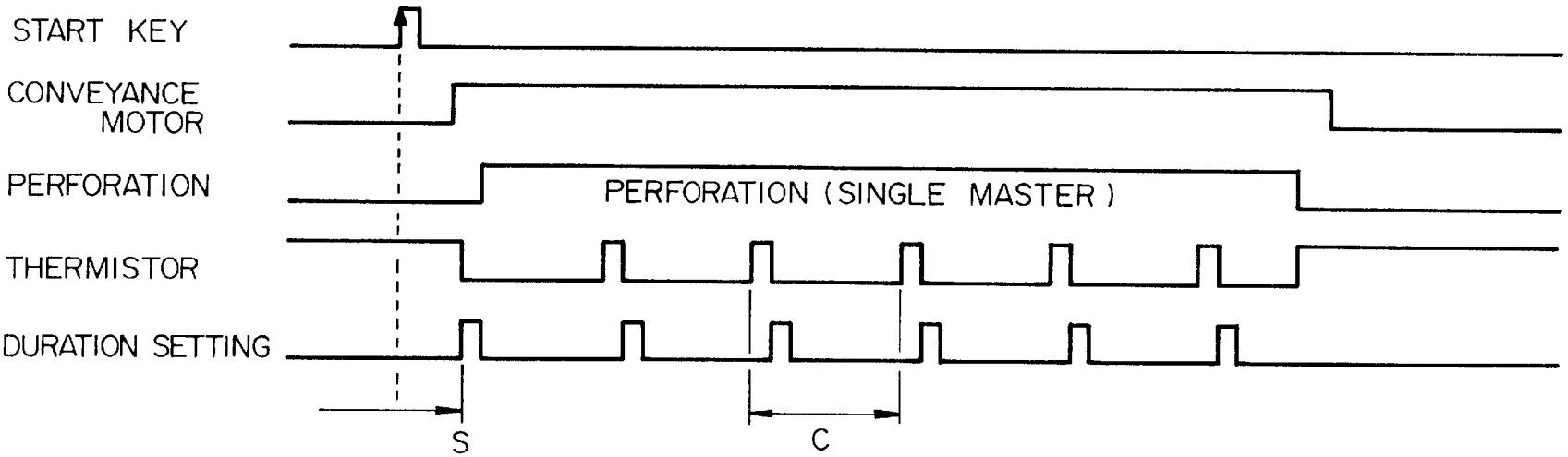
FIG. 16 is a timing chart demonstrating correction control unique to the illustrative embodiment.

Before a time S shown in FIG. 16, the illustrative embodiment, like the conventional printer, repeatedly senses ambient temperature around the head 30 with the thermistor 200 at a preselected period. In the illustrative embodiment, the preselected period is selected to be 5 milliseconds.

Figure 17:
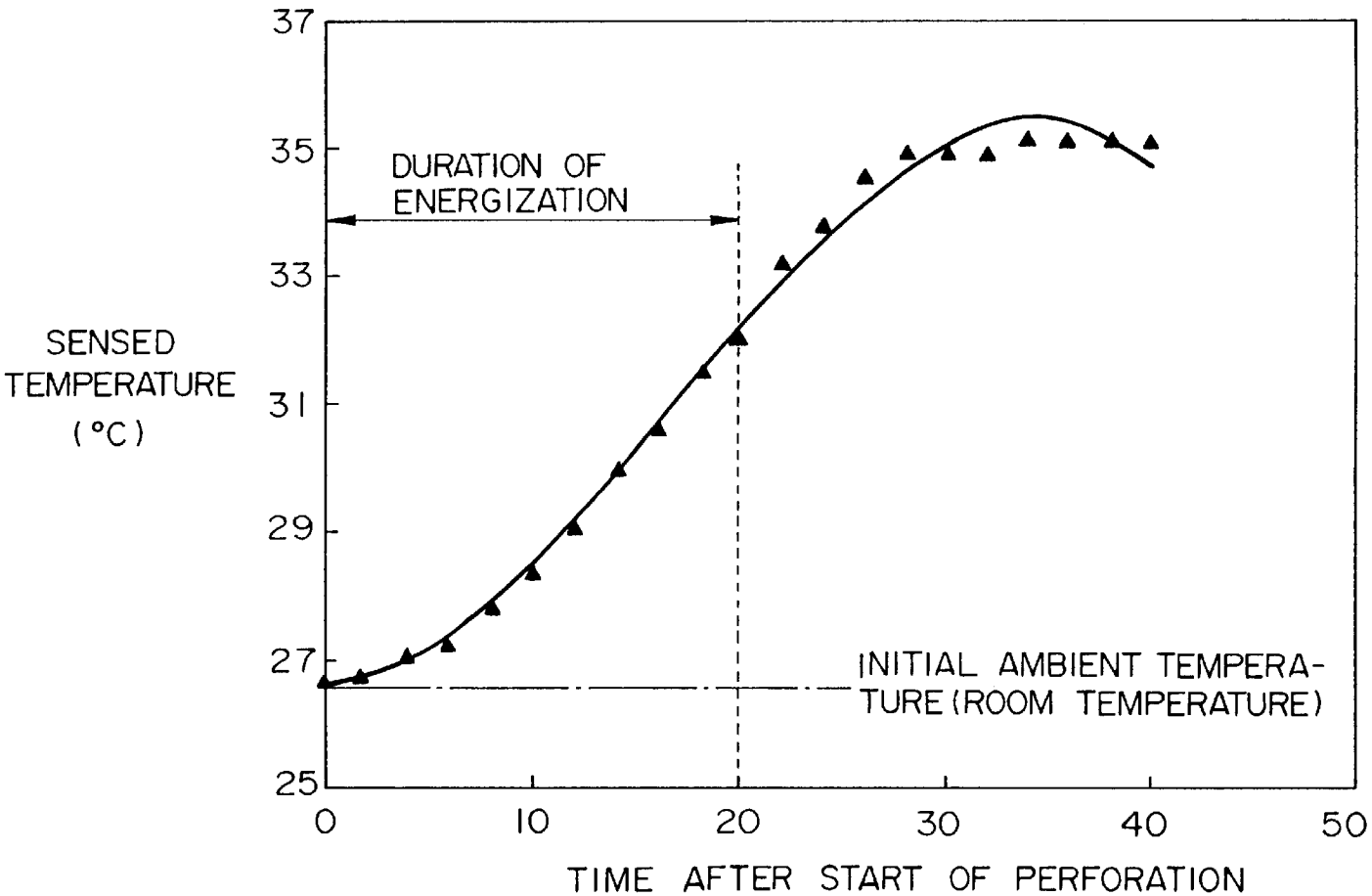
FIG. 17 is a graph showing a specific transition of temperature sensed by a thermistor included in the illustrative embodiment.

Why the interval C between the consecutive corrections should be 5 seconds or less will be described hereinafter. In the illustrative embodiment, the head 30 has the following specification and is driven under the following conditions:

Thermal Head Type size: A3 resolution: 600 dpi aluminum radiator size (1×w×t):
316×21×21.4×8 mm total number of heat generating elements:
7,168 dots glaze layer thickness: 40 $\mu$m (glass glaze)

low heat accumulation structure: using gel thermistor characteristic values:
R(25)=30 kΩ±5%
B=3,970±80 K Drive Conditions line period: 2 ms/l power applied: 0.0425 W (constant voltage drive)

maximum number of simultaneous energization:
3,584 dots duration of energization: 598 $\mu$s correction system: adjustment of duration When a black solid image sized 303×420 mm was formed in a stencil under the above conditions, the output of the thermistor 200 indicated temperature elevation shown in FIG. 17. After the start of a master making operation under the above drive conditions, the perforation area, which is one of the perforation conditions, varied as indicated by "no correction" in FIG. 18. As FIG. 18 indicates, when the correction is not executed, the perforation area noticeably varies between the time at which a master making operation starts and the time when it ends. This problem is ascribable to heat accumulated in the thermal head 30 and has recently been highlighted in relation to the demands for high resolution, high-speed master making, and space saving.

Figure 18:
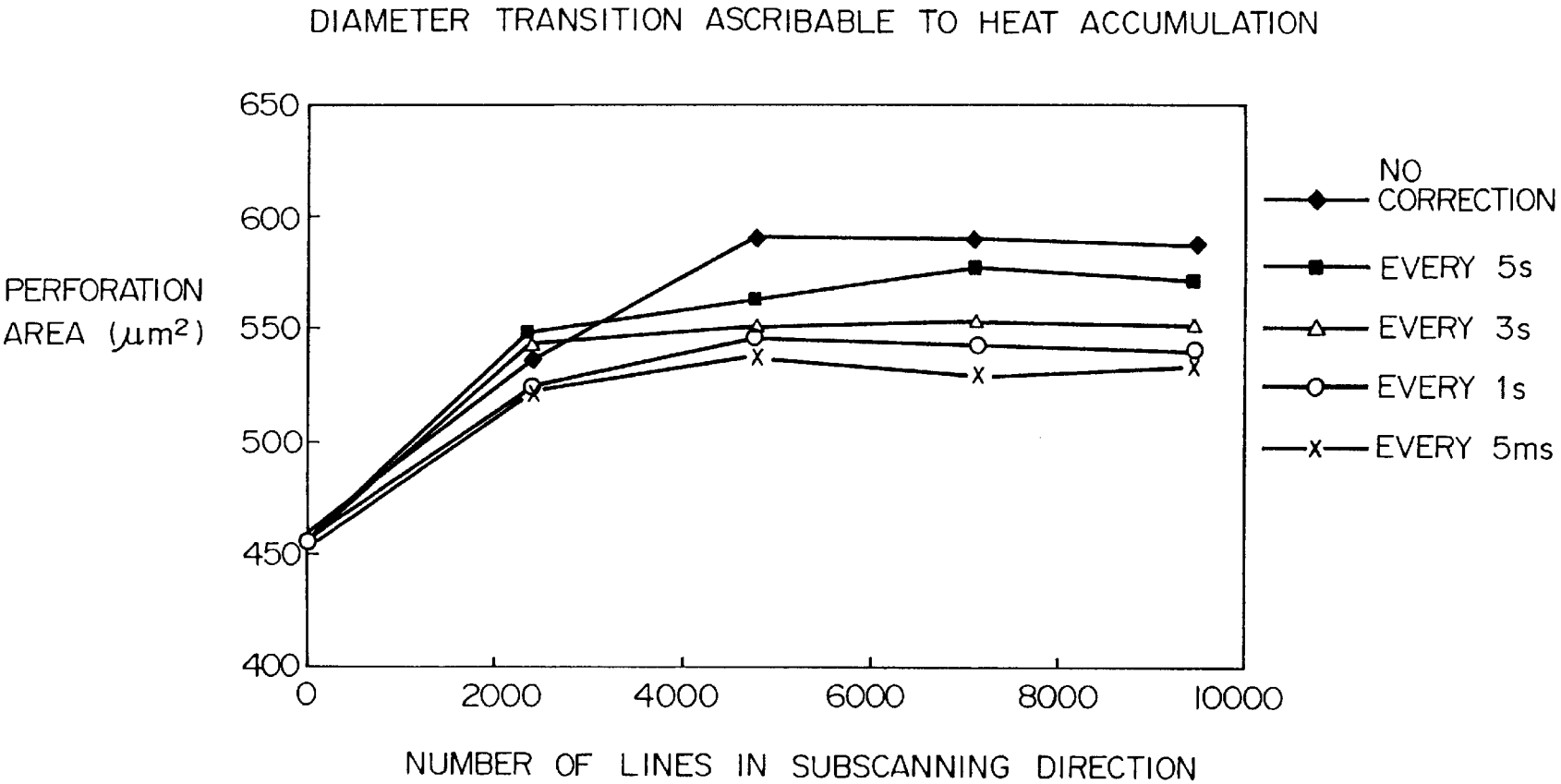
FIG. 18 is a graph showing the transition of a perforation area ascribable to heat accumulated in a thermal head.

In light of the above, the correction control was experimentally repeated at the periods of 5 seconds, 3 seconds, 1 second and 5 milliseconds by using the specification of the head 30 and drive conditions mentioned earlier. FIG. 18 shows the results of such correction control. It will be seen that the correction repeated even during master making operation reduces the variation of the perforation condition. The correction during master making operation further reduces the variation of the perforation condition if repeated at short intervals.

Further, the correction control based on the ambient temperature is executed when the temperature difference is less than 2.75° C. (2° C. in the illustrative embodiment). Assume that the correction based on the ambient temperature is effected when the drive condition (duration of energization) of the head 30 is varied during master making operation. Then, any noticeable change in a printed image before and after the correction is critical. This is why the drive condition of the thermal head 30 is varied if the temperature difference (transitional temperature difference) is 2.27° C. or less that does not bring about the above noticeable change.

Figure 19:
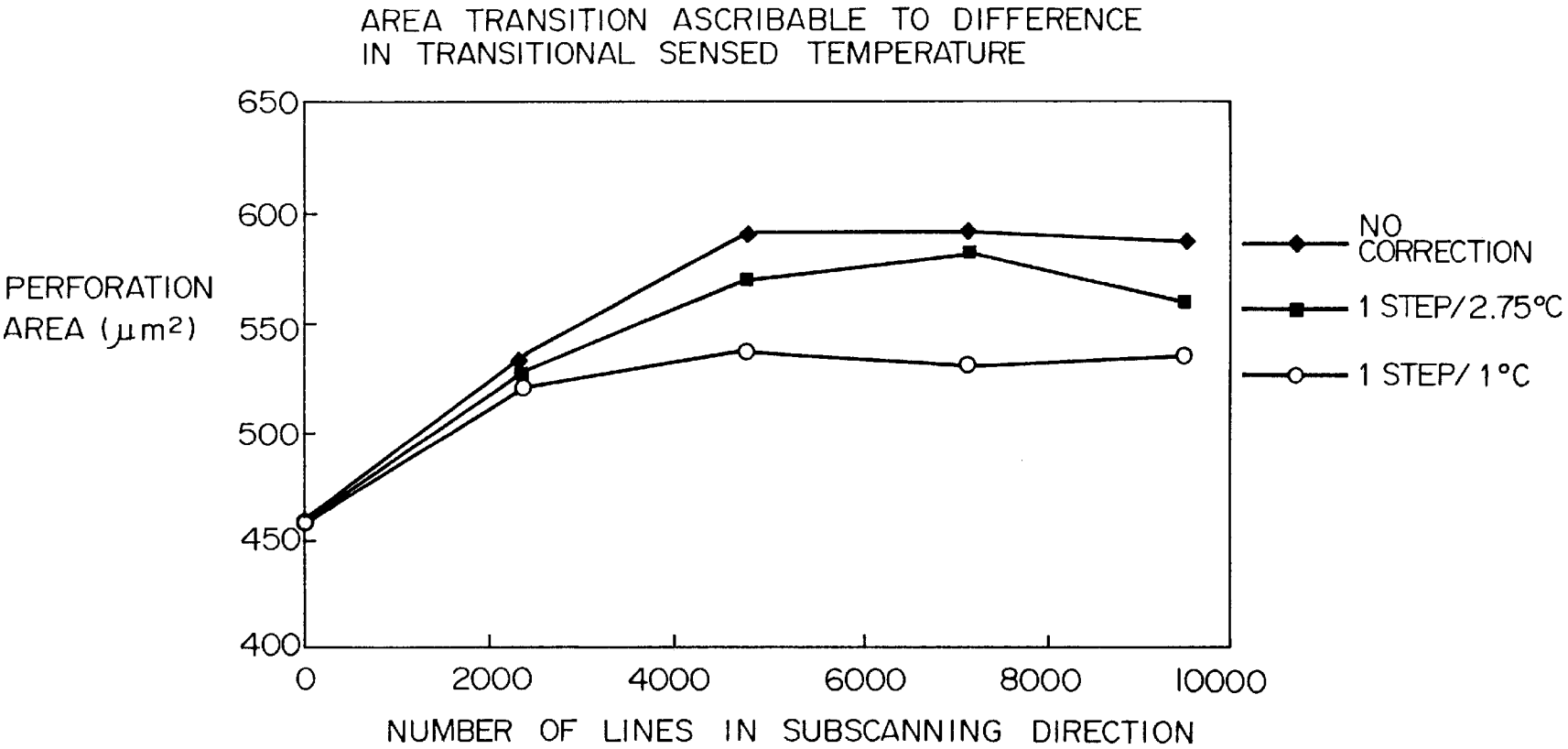
FIG. 19 is a graph showing the transition of perforation area ascribable to temperature difference.

FIG. 19 shows the results of experiments in which the transitional temperature difference of the ambient temperature was varied. As FIG. 19 indicates, the lower the temperature difference for a single step, the transition of the perforation condition is more reduced. Minutely dividing the temperature difference is identical in meaning with reducing the interval between consecutive corrections.

Figure 20:
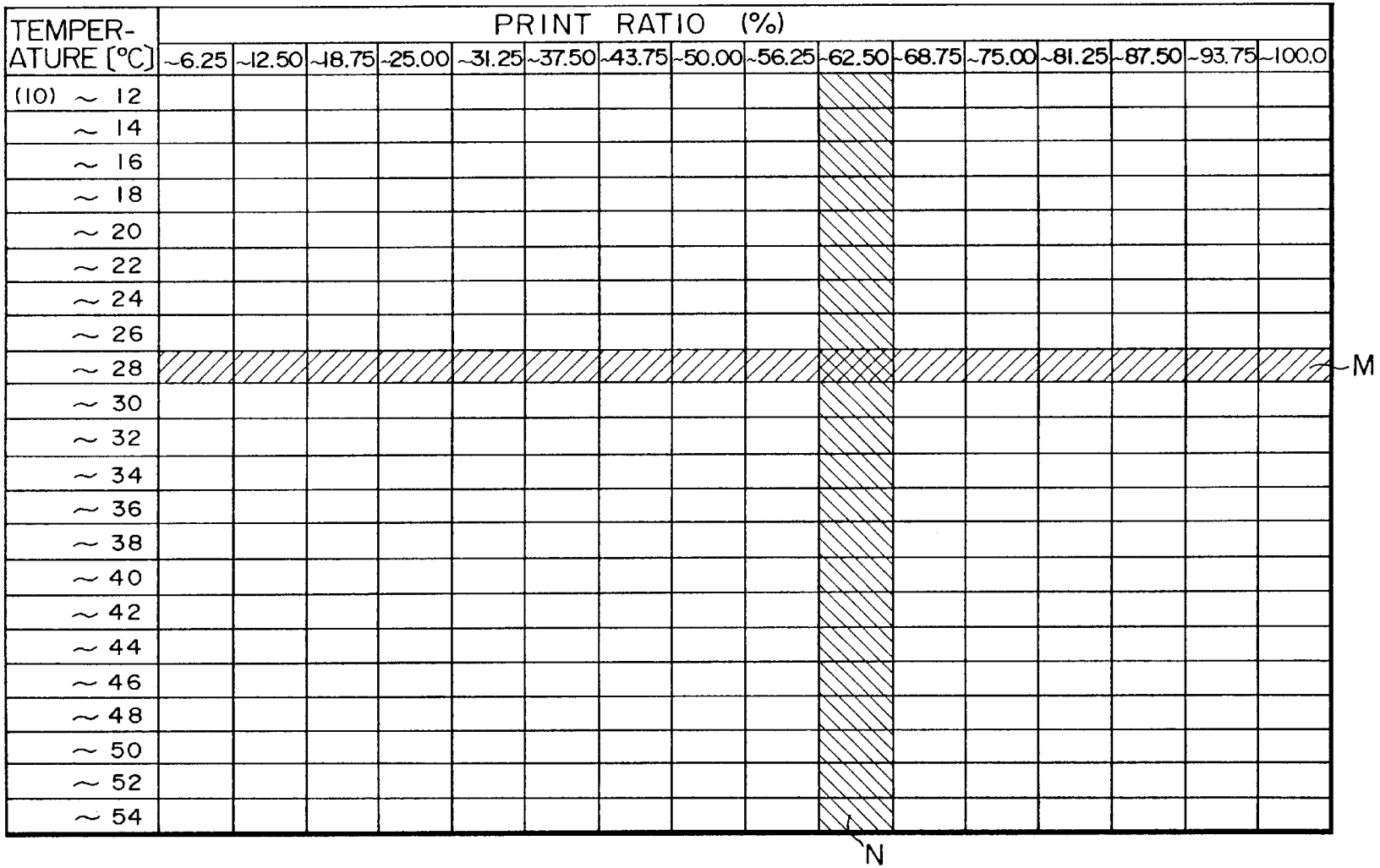
FIG. 20 is a table showing a relation between ambient temperature and print ratio data.

The control of the master making device 90 will be described with reference to FIGS. 15 and 20. As shown in FIG. 20, there is experimentally determined a combination of twenty-two patterns of duration data based on ambient temperature (step of 2° C.) and sixteen patterns of duration data based on print ratio (common drop correction), i.e., a 22×16 matrix. This matrix is stored in a ROM, not shown, included in the heat correcting section 204.

Assume that the output of the thermistor 200 representative of the instantaneous ambient temperature is input to the CPU 208, and that ambient temperature is 27° C. by way of example. Then, the CPU 208 selects a duration data region M corresponding to the ambient temperature and narrows it down to sixteen patterns. Also, assume that the output of the image data counter 202 input to the CPU 208 indicates a print ratio of 60% by way of example. Then, the CPU 208 selects a duration data region N corresponding to the above print ratio.

Subsequently, the CPU 208 selects duration data located at a position where the two regions M and N cross each other, and sends the data to the duration generating counter 212. The duration generating counter 212 sets the duration therein and feeds it to the thermal head controller 214. In response, the thermal head controller 214 drives the heat generating elements of the head 30 for the duration set. Such correction control is repeated five consecutive times during a single master making operation.

In the illustrative embodiment, the print ratio detecting means may be omitted, in which case the amount of heat will be corrected alone on the basis of ambient temperature.

Figure 21:
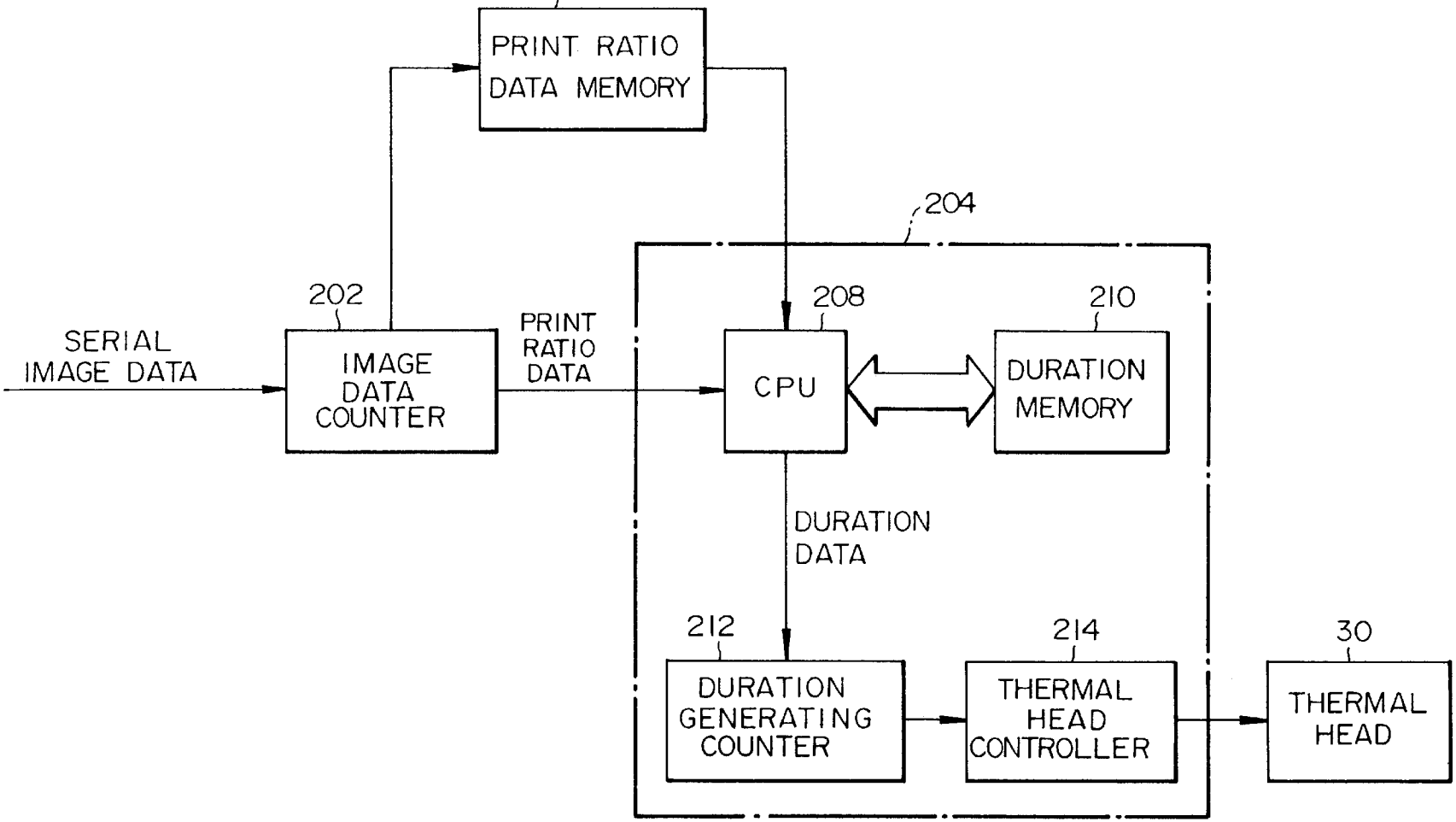
FIG. 21 is a schematic block diagram showing a control system representative of an alternative embodiment of the present invention.

FIG. 21 shows an alternative embodiment of the present invention. As shown, this embodiment includes a print ratio data memory or storing means 206. The data output from the image data counter 202 is written to the print ratio data memory 206. More specifically, past print ratio data (progress of heat generation) of the individual simultaneous energization block are written to the print ratio data memory 206. In the illustrative embodiment, the CPU 208 estimates, based on the past print ratio data, the ambient temperature around the thermal head 30 to occur at the time of the next heat generation. The CPU 208 then selects a duration of energization of the head 30 matching with the estimated ambient temperature and experimentally determined beforehand out of a preselected table. The table listing a relation between the ambient temperature and the duration of energization is not shown.

The circuitry of FIG. 21 may be modified such that the CPU 208 selects, based on the past print ratio data (total number of heat generating elements) stored in the print ratio data memory 206, a duration of energization of the head 30 experimentally determined beforehand. A table showing a relation between the print ratio data and the duration of energization is not shown. Alternatively, the CPU 208 may select a correction coefficient corresponding to the past print ratio data stored in the memory 206 and determined by experiments beforehand. A table showing a relation between the print ratio data and the correction coefficient is not shown.

Figure 22:
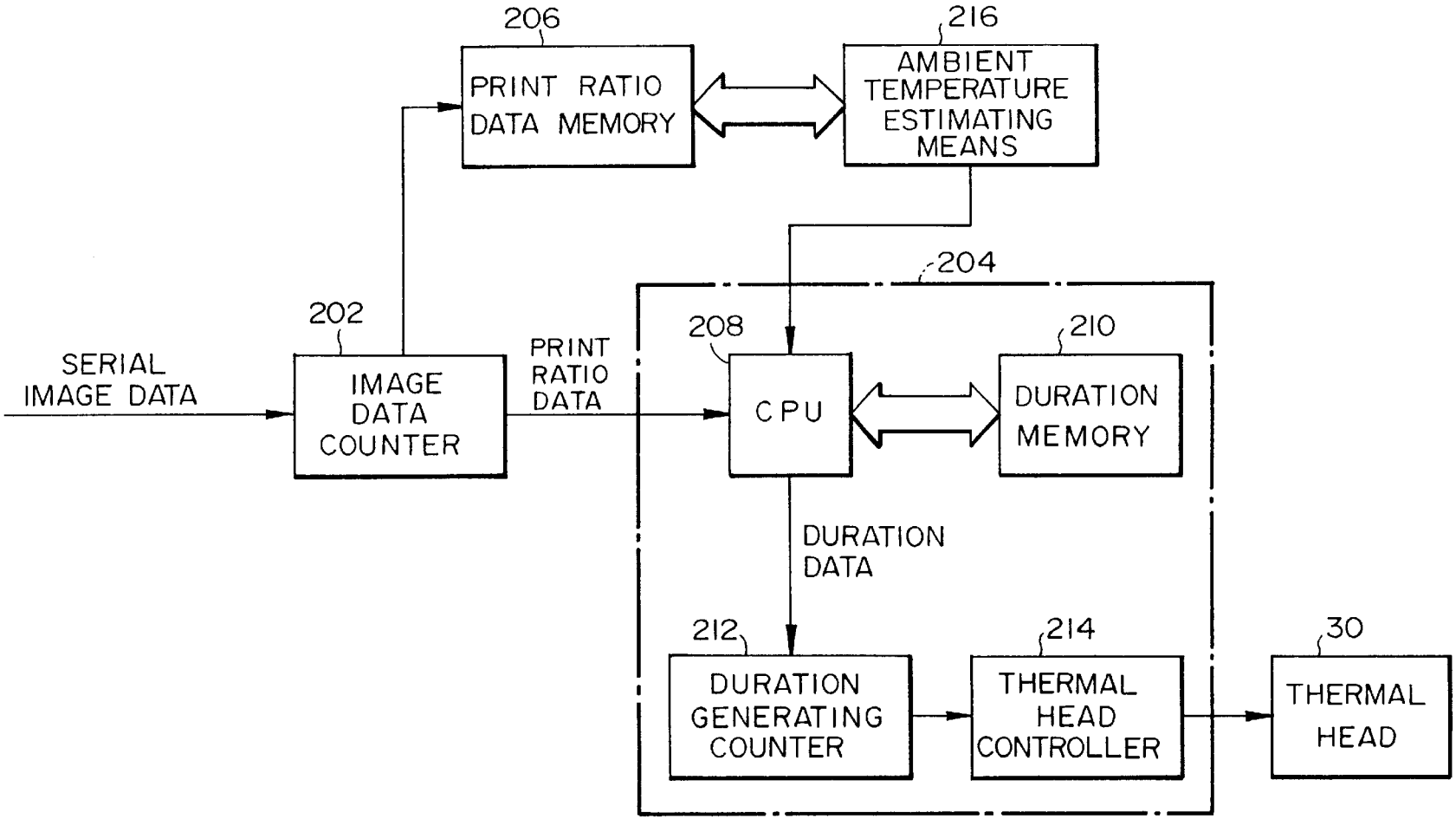
FIG. 22 is a schematic block diagram showing a control system representative of another alternative embodiment of the present invention.

FIG. 22 shows another alternative embodiment of the present invention. As shown, this embodiment includes ambient temperature estimating means 216 for estimating, based on the past print ratio data stored in the print ratio data memory 206, ambient temperature around the thermal heat 30 to occur at the time of the next heat generation. The CPU 208 selects a duration of energization of the head 30 corresponding to the estimated ambient temperature and experimentally determined beforehand. A table showing a relation between the ambient temperature and the duration of energization is not shown.

In summary, it will be seen that the present invention provides a thermal master making device and a thermal printer including the same having various unprecedented advantages, as enumerated below.

(1) The amount of heat to be generated is corrected on the basis of ambient temperature during master making operation. The amount of heat can therefore be controlled in accordance with a change in the heat accumulation characteristic of a thermal head, so that a change in perforation condition is reduced. This successfully realizes high resolution, high-speed master making and space saving required of a thermal master making device while obviating offset and enhancing the resistance of a master to repeated printing.

(2) The amount of heat to be generated is controlled on the basis of data representative of past heat generation. This allows a heat accumulation characteristic particular to a thermal head and the current heat accumulation characteristic to be accurately grasped and thereby insures highly accurate heat correction.

(3) Correction based on ambient temperature and correction based on print ratio data are effected at the same time. This allows the current heat accumulation characteristic of a thermal head to be accurately grasped in manifold aspects and thereby insures highly accurate heat correction.

(4) The master making device achieves high resolution, high-speed master making and space saving at low cost because it is practicable without resorting to any substantial change in conventional basic circuitry.

Various modifications will become possible for those skilled in the art after receiving the teachings of the present disclosure without departing from the scope thereof.

What is claimed is:

1. A thermal master making device including a thermal head, which have a plurality of heat generating elements arranged in an array in a main scanning direction, moving a thermosensitive medium relative to said thermal head in a subscanning direction perpendicular to the main scanning direction while pressing said thermosensitive medium against said thermal head, and causing said plurality of heat generating elements to repeatedly generate heat in accordance with an image signal to thereby make a master, said thermal master making device comprising:

sensing means for sensing ambient temperature around the thermal head; and correcting means for correcting an amount of heat to be generated by the thermal head in accordance with the ambient temperature sensed by said sensing means;

wherein the amount of heat is corrected on the basis of the ambient temperature during master making operation so as to control print quality.

2. A device as claimed in claim 1, wherein the amount of heat is corrected at least two times during a single master making operation.

3. A device as claimed in claim 2, wherein the amount of heat is corrected at an interval of 5 seconds or less.

4. A device as claimed in claim 1, wherein the amount of heat is corrected if a temperature difference is less than 2.75° C.

5. In a thermal printer including a thermal master making device that includes a thermal head having a plurality of heat generating elements arranged in an array in a main scanning direction, moves a thermosensitive medium relative to said thermal head in a subscanning direction perpendicular to the main scanning direction while pressing said thermosensitive medium against said thermal head, and causes said plurality of heat generating elements to repeatedly generate heat in accordance with an image signal to thereby make a master, said thermal master making device comprises:

sensing means for sensing ambient temperature around the thermal head; and correcting means for correcting an amount of heat to be generated by the thermal head in accordance with the ambient temperature sensed by said sensing means;

wherein the amount of heat is corrected on the basis of the ambient temperature during master making operation so as to control print quality.

6. A thermal master making device including a thermal head, which have a plurality of heat generating elements arranged in an array in a main scanning direction, moving a thermosensitive medium relative to said thermal head in a subscanning direction perpendicular to the main scanning direction while pressing said thermosensitive medium against said thermal head, and causing said plurality of heat generating elements to repeatedly generate heat in accordance with an image signal to thereby make a master, said thermal master making device comprising:

sensing means for sensing an ambient temperature around the thermal head;

detecting means for detecting a print ratio in terms of a number of heat generating elements to be energized at the same time; and correcting means for correcting an amount of heat to be generated by the thermal head on the basis of the ambient temperature sensed by said sensing means and the print ratio data output from said detecting means, wherein the amount of heat to be generated by the thermal head is corrected during master making operation so as to control print quality.

7. A device as claimed in claim 6, wherein the amount of heat is corrected at least two times during a single master making operation.

8. A device as claimed in claim 7, wherein the amount of heat is corrected at an interval of 5 seconds or less.

9. A device as claimed in claim 6, wherein the amount of heat is corrected if a temperature difference is less than 2.75° C.

10. In a thermal printer including a thermal master making device that includes a thermal head, which have a plurality of heat generating elements arranged in an array in a main scanning direction, moves a thermosensitive medium relative to said thermal head in a subscanning direction perpendicular to the main scanning direction while pressing said thermosensitive medium against said thermal head, and causes said plurality of heat generating elements to repeatedly generated heat in accordance with an image signal to thereby make a master, said thermal master making device comprising:

sensing means for sensing an ambient temperature around the thermal head;

detecting means for detecting a print ratio in terms of a number of heat generating elements to be energized at the same time; and correcting means for correcting an amount of heat to be generated by the thermal head on the basis of the ambient temperature sensed by said sensing means and the print ratio data output from said detecting means;

wherein the amount of heat to be generated by the thermal head is corrected during master making operation so as to control print quality.

11. A thermal master making device including a thermal head, which have a plurality of heat generating elements arranged in an array in a main scanning direction, moving a thermosensitive medium relative to said thermal head in a subscanning direction perpendicular to the main scanning direction while pressing said thermosensitive medium against said thermal head, and causing said plurality of heat generating elements to repeatedly generate heat in accordance with an image signal to thereby make a master, said thermal master making device comprising:

a sensor configured to sense ambient temperature around the thermal head; and a correcting circuit configured to correct an amount of heat to be generated by the thermal head in accordance the ambient temperature sensed by said sensor;

wherein the amount of heat is corrected on the basis of the ambient temperature during master making operation so as to control print quality.

12. A device as claimed in claim 11, wherein the amount of heat is corrected at least two times during a single master making operation.

13. A device as claimed in claim 12, wherein the amount of heat is corrected at an interval of 5 seconds or less.

14. A device as claimed in claim 11, wherein the amount of heat is corrected if a temperature difference is less than 2.75° C.

15. In a thermal printer including a thermal master making device that includes a thermal head having a plurality of heat generating elements arranged in an array main scanning direction, moves a thermosensitive medium relative to said thermal head in a subscanning direction perpendicular to the main scanning direction while pressing said thermosensitive medium against said thermal head, and causes said plurality of heat generating elements to repeatedly generate heat in accordance with an image signal to thereby make a master, said thermal master making device comprises:

a sensor configured to sense ambient temperature around the thermal head; and a correcting circuit configured to correct an amount of heat to be generated by the thermal head in accordance with the ambient temperature sensed by said sensor;

wherein the amount of heat is corrected on the basis of the ambient temperature during master making operation so as to control print quality.

16. A thermal master making device including a thermal head, which have a plurality of heat generating elements arranged in an array in a main scanning direction, moving a thermosensitive medium relative to said thermal head in a subscanning direction perpendicular to the main scanning direction while pressing said thermosensitive medium against said thermal head, and causing said plurality of heat generating elements to repeatedly generate heat in accordance with an image signal to thereby make a master, said thermal master making device comprising:

a sensor configured to sense an ambient temperature around the thermal head;

a detecting circuit configured to detect a print ratio in terms of a number of heat generating elements to be energized at the same time; and a correcting circuit configured to correct an amount of heat to be generated by the thermal head on the basis of the ambient temperature sensed by said sensor and the print ratio data output from said detecting circuit, wherein the amount of heat to be generated by the thermal head is corrected during master making operation so as to control print quality.

17. A device as claimed in claim 16, wherein the amount of heat is corrected at least two times during a single master making operation.

18. A device as claimed in claim 17, wherein the amount of heat is corrected at an interval of 5 seconds or less.

19. A device as claimed in claim 16, wherein the amount of heat is corrected if a temperature difference is less than 2.75° C.

20. In a thermal printer including a thermal master making device that includes a thermal had, which have a plurality of heat generating elements arranged in an array in a main scanning direction, moves a thermosensitive medium relative to said thermal head in a subscanning direction perpendicular to the main scanning direction while pressing said thermosensitive medium against said thermal head, and causes said plurality of heat generating elements to repeatedly generate heat in accordance with an image signal to thereby make a master, said thermal master making device comprising:

a sensor configured to sense an ambient temperature around the thermal head;

a detecting circuit configured to detect a print ratio in terms of a number of heat generating elements to be energized at the same time; and a correcting circuit for correcting an amount of heat to be generated by the thermal head on the basis of the ambient temperature sensed by said sensor and the print ratio data output from said detecting circuit, wherein the amount of heat to be generated by the thermal head is corrected during master making operation so as to control print quality.

21. A method for making a thermal master using a thermal master making device including a thermal head having a plurality of heat generating elements arranged in an array in a main scanning direction, and a thermosensitive medium moveable relative to said thermal head in a subscanning direction perpendicular to the main scanning direction while pressing said thermosensitive medium against said thermal head so as to cause said plurality of heat generating elements to repeatedly generate heat in accordance with an image signal, said method comprising:

sensing ambient temperature around the thermal head; and correcting an amount of heat to be generated by the thermal head in accordance with the ambient temperature sensed during master making operation so as to control print quality.

22. A method for making a thermal master using a thermal master making device including a thermal head having a plurality of heat generating elements arranged in an array in a main scanning direction, and a thermosensitive medium moveable relative to said thermal head in a subscanning direction perpendicular to the main scanning direction while pressing said thermosensitive medium against said thermal head so as to cause said plurality of heat generating elements to repeatedly generate heat in accordance with an image signal, said method comprising:

sensing an ambient temperature around the thermal head;

detecting a print ratio in terms of a number of heat generating elements to be energized at the same time; and correcting an amount of heat to be generated by the thermal head on the basis of the ambient temperature sensed and the print ratio data output during master making operation so as to control print quality.

* * * * *

UNITED STATES PATENT AND TRADEMARK OFFICE

CERTIFICATE OF CORRECTION

PATENT NO. : 6,747,682 B2
DATED : June 8, 2004
INVENTOR(S) : Yasunobu Kidoura et al.

It is certified that error appears in the above-identified patent and that said Letters Patent is hereby corrected as shown below:

Column 7,
Line 23, change "14*l*" to -- 14 --;

Column 8,
Lines 18, 19 and 21, change "damper" to -- clamper --.

Signed and Sealed this

Twenty-third Day of May, 2006

JON W. DUDAS
*Director of the United States Patent and Trademark Office*